US011645978B2

(12) United States Patent
Bao et al.

(10) Patent No.: US 11,645,978 B2
(45) Date of Patent: May 9, 2023

(54) DATA PROCESSING METHOD AND DEVICE, AND DISPLAY PANEL

(71) Applicants: Hefei Xinsheng Optoelectronics Technology Co., Ltd., Anhui (CN); BOE TECHNOLOGY GROUP CO., LTD., Beijing (CN)

(72) Inventors: Wenchao Bao, Beijing (CN); Xiaolong Wei, Beijing (CN)

(73) Assignees: Hefei Xinsheng Optoelectronics Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/417,501

(22) PCT Filed: Dec. 9, 2020

(86) PCT No.: PCT/CN2020/134807
§ 371 (c)(1),
(2) Date: Jun. 23, 2021

(87) PCT Pub. No.: WO2021/115307
PCT Pub. Date: Jun. 17, 2021

(65) Prior Publication Data

US 2022/0122539 A1 Apr. 21, 2022

(30) Foreign Application Priority Data

Dec. 10, 2019 (CN) ..... 201911259654.5

(51) Int. Cl.
*G09G 3/3258* (2016.01)
*G09G 3/00* (2006.01)
*G09G 3/3266* (2016.01)

(52) U.S. Cl.
CPC ..... *G09G 3/3258* (2013.01); *G09G 3/006* (2013.01); *G09G 3/3266* (2013.01); *G09G 2300/043* (2013.01)

(58) Field of Classification Search
CPC .... G09G 3/3258; G09G 3/006; G09G 3/3266; G09G 2300/043; G09G 3/3233;
(Continued)

(56) References Cited

U.S. PATENT DOCUMENTS 10,818,236 B2 * 10/2020 Gai ..... G09G 3/3233
2011/0227964 A1 * 9/2011 Chaji ..... G09G 3/006 345/82

(Continued)

FOREIGN PATENT DOCUMENTS

CN 104637444 A 5/2015
CN 105390111 A 3/2016

(Continued)

OTHER PUBLICATIONS

China Patent Office, First Office Action dated Jan. 28, 2021 for application No. CN201911259654.5.

*Primary Examiner* — Jose R Soto Lopez
(74) *Attorney, Agent, or Firm* — Houtteman Law LLC

(57) ABSTRACT

The present disclosure provides method and device for processing compensation data to be applied to a pixel circuit, and a display panel. The method includes: receiving M compensation data; determining a first threshold range according to (i−N)-th to (i−1)-th standard data, wherein midpoint and length of the first threshold range both depend on the (i−N)-th to (i−1)-th standard data; judging whether an i-th compensation data is in the first threshold range or not; in response to the i-th compensation data being in the first threshold range, determining the i-th compensation data as qualified and using it as an i-th standard data; and in response to the i-th compensation data not being in the first (Continued)

threshold range, determining the i-th compensation data as unqualified, replacing it with an average value of the (i−N)-th to (i−1)-th standard data, and using the replaced i-th compensation data as the i-th standard data.

12 Claims, 5 Drawing Sheets

(58) Field of Classification Search
CPC ... G09G 2300/0426; G09G 2320/0295; G09G 2320/045; G09G 3/3208
See application file for complete search history.

(56) References Cited

U.S. PATENT DOCUMENTS

2012/0001892 A1* 1/2012 Kojima ..... H03F 3/45183 345/212
2013/0106821 A1* 5/2013 Aubert ..... G09G 3/34 345/84
2014/0176401 A1* 6/2014 Kim ..... G09G 3/3233 345/76
2015/0084946 A1* 3/2015 Shim ..... G09G 3/3291 345/212
2015/0145845 A1* 5/2015 Nam ..... G09G 3/3233 345/212
2015/0179103 A1* 6/2015 Tani ..... G09G 3/20 345/690
2015/0179107 A1* 6/2015 Kim ..... G09G 3/3233 345/82
2016/0117974 A1* 4/2016 Back ..... G09G 3/3275 345/213
2016/0148571 A1* 5/2016 Cho ..... G09G 3/3266 345/212
2017/0025061 A1* 1/2017 Takizawa ..... G09G 3/3291
2017/0061892 A1* 3/2017 Jung ..... G09G 3/3291
2017/0186369 A1* 6/2017 Hayashi ..... G09G 3/3233
2017/0287414 A1* 10/2017 Uriostigue ..... G09G 3/2003
2018/0182283 A1* 6/2018 Lim ..... G09G 3/3233
2018/0240403 A1* 8/2018 Wang ..... G01R 19/2509
2018/0350303 A1* 12/2018 Jin ..... G09G 3/3233
2018/0357959 A1* 12/2018 Xiang ..... G09G 3/3258
2019/0130837 A1* 5/2019 Chen ..... G09G 3/3233
2019/0172394 A1* 6/2019 Wang ..... G09G 3/3258
2020/0035154 A1* 1/2020 Zeng ..... G09G 5/10
2020/0105197 A1* 4/2020 Yin ..... G09G 3/3258
2020/0212332 A1* 7/2020 Shim ..... G09G 3/3233
2020/0273405 A1* 8/2020 Yang ..... G09G 3/3258
2020/0402432 A1* 12/2020 Yang ..... G09G 3/3233
2021/0020105 A1* 1/2021 Yin ..... G09G 3/3275
2021/0027712 A1* 1/2021 Kim ..... G09G 3/3291
2021/0104195 A1* 4/2021 Choi ..... G09G 3/3233
2021/0158771 A1* 5/2021 Tanaka ..... G09G 3/18
2021/0407436 A1* 12/2021 Park ..... G09G 3/3233

FOREIGN PATENT DOCUMENTS

CN 106125367 A 11/2016
CN 106910463 A 6/2017
CN 108399891 A 8/2018
CN 108491875 A 9/2018
CN 109637445 A 4/2019
CN 109671393 A 4/2019
CN 109949748 A 6/2019
CN 110085182 A 8/2019
CN 110930913 A 3/2020

* cited by examiner

DATA PROCESSING METHOD AND DEVICE, AND DISPLAY PANEL

CROSS-REFERENCE TO RELATED APPLICATION

This is a National Phase Application filed under 35 U.S.C. 371 as a national stage of PCT/CN2020/134807, filed on Dec. 9, 2020, an application claiming the benefit of priority to Chinese Patent Application No. 201911259654.5 filed on Dec. 10, 2019 to China National Intellectual Property Administration, the contents of which are incorporated herein in their entirety by reference.

TECHNICAL FIELD

The present disclosure relates to the field of display technology, and particularly relates to a data processing method and device, and a display panel.

BACKGROUND

In a display panel (e.g., an organic light emitting diode (OLED) display panel), light emission of a light emitting unit thereof is generally controlled by a transistor. However, due to a long usage time or other external environment, the threshold voltage of the transistor may change, thereby causing display abnormality of the display panel. In order to solve the above problem, it is generally necessary to apply a compensation value to the pixel circuit to compensate for the change of the threshold voltage of the transistor.

SUMMARY

The present disclosure provides a method for processing compensation data to be applied to a pixel circuit, including:

receiving M compensation data, wherein the M compensation data are respectively used for M adjacent pixel circuits, any two adjacent compensation data are respectively used for two adjacent pixel circuits, and M is an integer greater than or equal to 3;

determining a first threshold range according to (i−N)-th to (i−1)-th standard data, wherein a midpoint of the first threshold range and a length of the first threshold range both depend on the (i−N)-th to (i−1)-th standard data, i is an integer greater than N and less than or equal to M, and N is an integer greater than or equal to 2;

judging whether an i-th compensation data is in the first threshold range or not;

in response to the i-th compensation data being in the first threshold range, determining the i-th compensation data to be qualified and using the i-th compensation data as an i-th standard data; and in response to the i-th compensation data not being in the first threshold range, determining the i-th compensation data to be unqualified, replacing the i-th compensation data with an average value of the (i−N)-th to (i−1)-th standard data, and using the replaced i-th compensation data as the i-th standard data.

In an embodiment of the present disclosure, determining a first threshold range based on (i-N)-th to (i−1)-th standard data includes:

obtaining the midpoint of the first threshold range and the length of the first threshold range according to the average value of the (i−N)-th to (i−1)-th standard data.

In an embodiment of the present disclosure, the first threshold range is (A1, A2), where A1 equals to the average value of the (i−N)-th to (i−1)-th standard data minus a product of a correction coefficient and the average value of the (i−N)-th to (i−1)-th standard data, A2 equals to the average value of the (i−N)-th to (i−1)-th standard data plus the product of the correction coefficient and the average value of the (i−N)-th to (i−1)-th standard data, and the correction coefficient is greater than zero and less than 1.

In an embodiment of the present disclosure, the correction coefficient is in a range of 5% to 20%.

In an embodiment of the present disclosure, the correction coefficient is 10%.

In an embodiment of the present disclosure, after in response to the i-th compensation data being in the first threshold range, determining the i-th compensation data to be qualified and using the i-th compensation data as an i-th standard data, the method includes:

obtaining a second threshold range according to (i−N+1)-th to i-th standard data, wherein a midpoint of the second threshold range and a length of the second threshold range both depend on the (i−N+1)-th to i-th standard data;

judging whether a (i+1)-th compensation data is in the second threshold range;

in response to the (i+1)-th compensation data being in the second threshold range, determining the (i+1)-th compensation data to be qualified, and using the (i+1)-th compensation data as a (i+1)-th standard data; and in response to the (i+1)-th compensation data not being in the second threshold range, determining the (i+1)-th compensation data to be unqualified, replacing the (i+1)-th compensation data with an average value of the (i−N+1)-th to i-th standard data, and using the replaced (i+1)-th compensation data as the (i+1)-th standard data.

In an embodiment of the present disclosure, obtaining a second threshold range according to (i−N+1)-th to i-th standard data includes:

obtaining the midpoint of the second threshold range and the length of the second threshold range according to the average value of the (i−N+1)-th to i-th standard data.

In an embodiment of the present disclosure, the second threshold range is (B1, B2), where B1 equals to the average value of the (i−N+1)-th to i-th standard data minus a product of a correction coefficient and the average value of the (i−N+1)-th to i-th standard data, and B2 equals to the average value of (i−N+1)-th to i-th standard data plus the product of the correction coefficient and the average value of the (i−N+1)-th to i-th standard data.

In an embodiment of the present disclosure, in a display process of each frame, when any row of pixels is scanned, the compensation data corresponding to the row of pixels is processed by using the method.

In another aspect, the present disclosure provides a processing device for processing compensation data to be applied to a pixel circuit. The processing device is configured to:

receive M compensation data, wherein the M compensation data are respectively used for M adjacent pixel circuits of a display panel, any two adjacent compensation data are respectively used for two adjacent pixel circuits, and M is an integer greater than or equal to 3;

determine a first threshold range according to (i−N)-th to (i−1)-th standard data, wherein a midpoint of the first threshold range and a length of the first threshold range both depend on the (i−N)-th to (i−1)-th standard data, i is an integer greater than N and less than or equal to M, and N is an integer greater than or equal to 2;

judge whether an i-th compensation data is in the first threshold range or not;

in response to the i-th compensation data being in the first threshold range, determine the i-th compensation data to be qualified, and use the i-th compensation data as an i-th standard data; and in response to the i-th compensation data not being in the first threshold range, determine the i-th compensation data to be unqualified, replace the i-th compensation data with an average value of the (i-N)-th to (i−1)-th standard data, and use the replaced i-th compensation data as the i-th standard data.

In an embodiment of the present disclosure, the processing device is configured to obtain the midpoint of the first threshold range and the length of the first threshold range according to the average value of the (i−N)-th to (i−1)-th standard data.

In an embodiment of the present disclosure, the first threshold range is (A1, A2), where A1 equals to the average value of the (i−N)-th to (i−1)-th standard data minus a product of a correction coefficient and the average value of the (i−N)-th to (i−1)-th standard data, A2 equals to the average value of the (i−N)-th to (i−1)-th standard data plus the product of the correction coefficient and the average value of the (i−N)-th to (i−1)-th standard data, and the correction coefficient is greater than zero and less than 1.

In another aspect, the present disclosure provides a display panel including: the processing device according to the present disclosure.

BRIEF DESCRIPTION OF THE DRAWINGS

The accompanying drawings, which are included to provide a further understanding of the present disclosure and constitute a part of this specification, serve to explain the present disclosure together with the following embodiments, but do not constitute a limitation of the present disclosure. In the drawings.

DETAILED DESCRIPTION

Figure 1A:
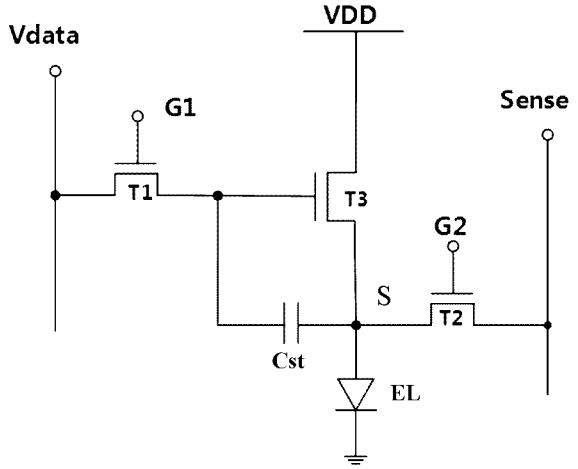
FIG. 1*a* is a schematic diagram of a pixel circuit in the related art.

In order that those skilled in the art will better understand the technical solutions of the present disclosure, the following detailed description is given with reference to the accompanying drawings and the specific embodiments.

The present disclosure will be described in more detail below with reference to the accompanying drawings. Like elements are denoted by like reference numerals throughout the drawings. For purposes of clarity, parts in the drawings are not drawn to scale. Moreover, certain well-known parts may not be shown in the drawings.

Numerous specific details of the present disclosure, such as structures, materials, dimensions, processes and techniques of the components, are set forth in the following description in order to provide a more thorough understanding of the present disclosure. However, as will be understood by those skilled in the art, the present disclosure may be practiced without these specific details.

Figure 1B:
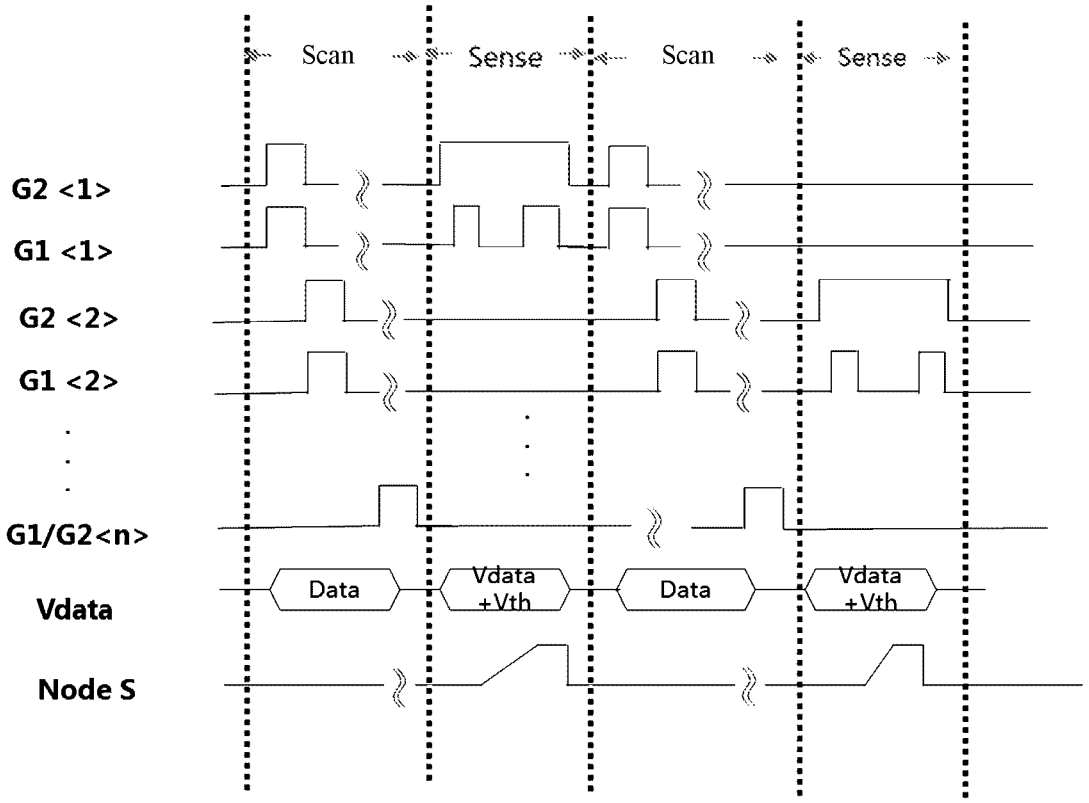
FIG. 1*b* is a timing diagram of the pixel circuit shown in FIG. 1*a;*
Figure 1C:
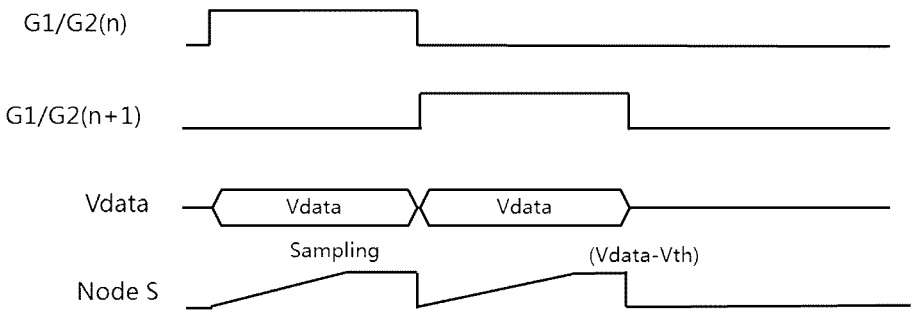
FIG. 1*c* is a shutdown compensation timing diagram of the pixel circuit shown in FIG. 1*a;*

FIG. 1*a* shows a pixel circuit having a 3T1C circuit. FIG. 1*b* is a compensation timing diagram of the pixel circuit shown in FIG. 1*a*, and FIG. 1*c* is a shutdown compensation timing diagram of the pixel circuit shown in FIG. 1*a*. As shown in FIG. 1*a*, the pixel circuit includes first to third transistors T1-T3, a data line Vdata, a DC power supply VDD, a sensing line Sense, a light emitting unit EL, a first control terminal G1, a second control terminal G2, and a capacitor Cst. An OLED product itself needs an electroluminescent device to emit light, and the required light emitting current needs to be provided by the driving transistor T3. Due to the difference in the driving transistor T3, correction needs to be made by external compensation.

Figure 1D:
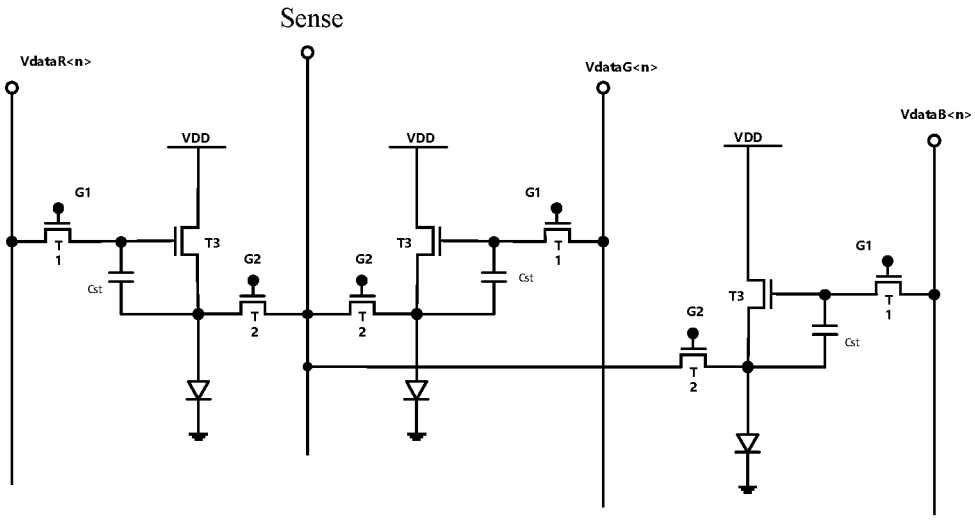
FIG. 1*d* shows an architecture of an nth row of pixels with the pixel circuit shown in FIG. 1*a;*

As shown in FIG. 1*a*, under the control of the second control terminal G2, the second transistor T2 transmits a voltage at a source electrode S of the third transistor T3 to the sensing line Sense, so that the sensing line Sense senses a voltage associated with the threshold voltage of the driving transistor T3. From the voltage sensed by the sensing line Sense, a compensation voltage for the pixel circuit can be obtained. The compensation voltage may be further supplied to the data line Vdata to implement compensation of the pixel circuit. In practical applications, one sensing line Sense may be connected to multiple pixel circuits simultaneously. Referring to FIG. 1*d*, the sensing line Sense of the pixel circuit may have a 1 for 3 design, or even a 1 for 6 design, a 1 for 12 design, etc.

Before applying the compensation data to the pixel circuit to compensate for the change of the threshold voltage of the transistor, the compensation data needs to be filtered to ensure the accuracy of the compensation data, so as to ensure that the display panel can normally display.

Figure 2A:
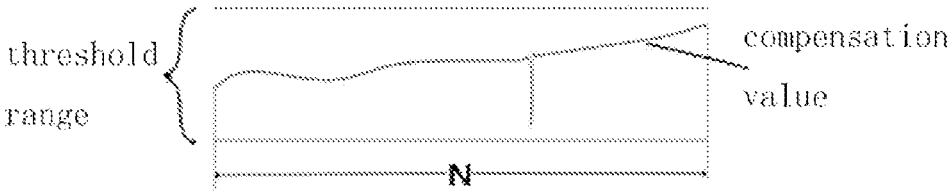
FIG. 2*a* is a schematic graph illustrating a method for processing compensation data in the related art.
Figure 2B:
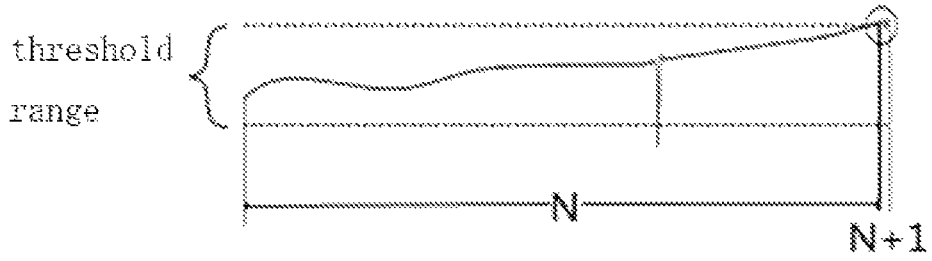
FIG. 2*b* is a schematic graph illustrating a method for processing compensation data in the related art.

FIGS. 2*a* and 2*b* are schematic graphs illustrating a method for processing compensation data in the related art. When the threshold range for determining whether data is abnormal is set as a fixed range, inaccurate determination may occur. As shown in FIG. 2*a*, if the threshold range is set too large, the abnormal compensation data may be determined as normal data, and the abnormal compensation data may cause abnormal display of the display panel, such as occurrence of a defect like an abnormal line. As shown in FIG. 2*b*, if the threshold range is set too small, the normal compensation data may be erroneously determined as abnormal data, and thus a defect such as a whitish display area may occur.

The present disclosure provides a method for processing compensation data to be applied to a pixel circuit, which can be used to accurately determine whether compensation data to be applied to the pixel circuit is abnormal.

Figure 3:
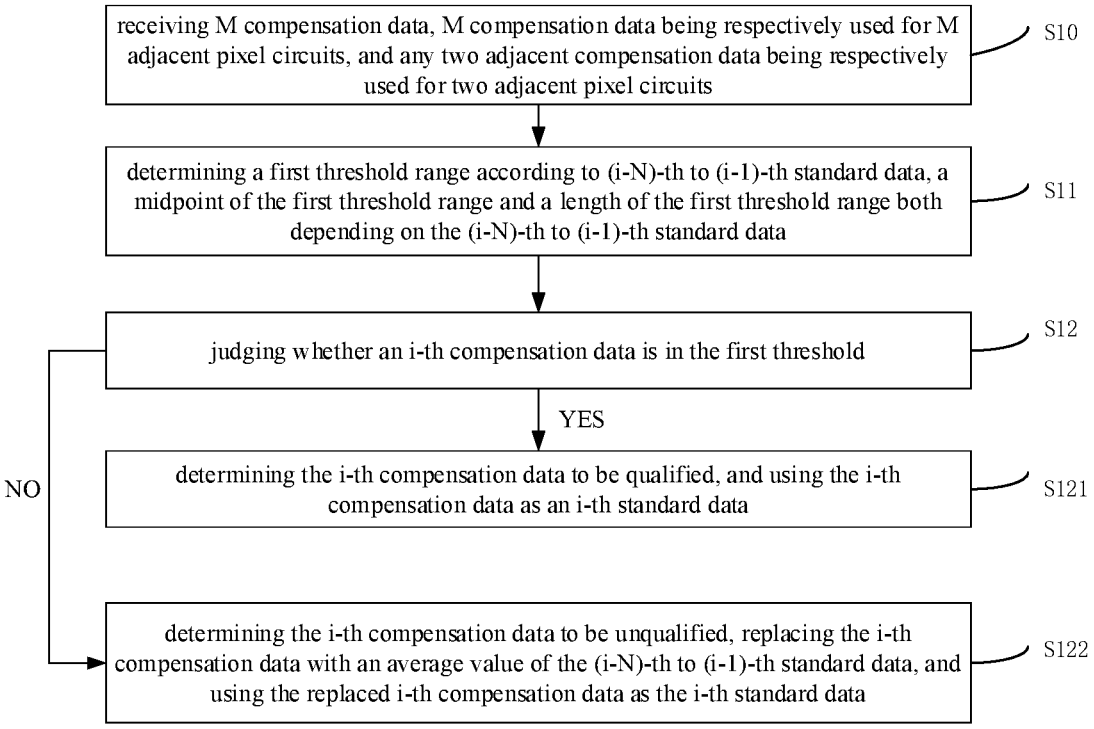
FIG. 3 is a schematic flow chart of a method for processing compensation data to be applied to a pixel circuit according to an embodiment of the present disclosure.

As shown in FIG. 3, the method according to the present disclosure includes:

step S10, receiving M compensation data, M compensation data being respectively used for M adjacent pixel circuits, and any two adjacent compensation data being respectively used for two adjacent pixel circuits, where M is an integer greater than or equal to 3;

step S11, determining a first threshold range according to (i−N)-th to (i−1)-th standard data, a midpoint of the first threshold range and a length of the first threshold range both depending on the (i−N)-th to (i−1)-th standard data, i being an integer greater than N and less than or equal to M, and N being an integer greater than or equal to 2;

step S12, judging whether an i-th compensation data is in the first threshold range or not;

step S121, in response to the i-th compensation data being in the first threshold range, determining the i-th compensation data to be qualified, and using the i-th compensation data as an i-th standard data; and step S122, in response to the i-th compensation data being not in the first threshold range, determining the i-th compensation data to be unqualified, replacing the i-th compensation data with an average value of the (i−N)-th to (i−1)-th standard data, and using the replaced i-th compensation data as the i-th standard data.

In the present disclosure, "standard data" refers to compensation data determined to be qualified. The first threshold range is related to a variation in the value of the standard data. It is understood that the compensation data (i.e., standard data) determined to be qualified is data which does not jump relative to its neighboring compensation data.

In the present disclosure, it is understood that for the threshold range (A, B), the midpoint is (A+B)/2 and the length is (B−A).

In the data processing method according to the embodiment of the present disclosure, the values of a plurality of compensation data to be processed are different. In judging the i-th compensation data, it is determined whether the i-th compensation data is qualified by using a first threshold range obtained based on N qualified compensation data (including the replaced compensation data) before the i-th compensation data. The midpoint and length of the first threshold range both depend on the (i−N)-th to (i−1)-th standard data. The data processing method according to the embodiment of the present disclosure can judge whether the i-th compensation data is qualified or not more accurately, so that the accuracy of the data is ensured.

Figure 4:
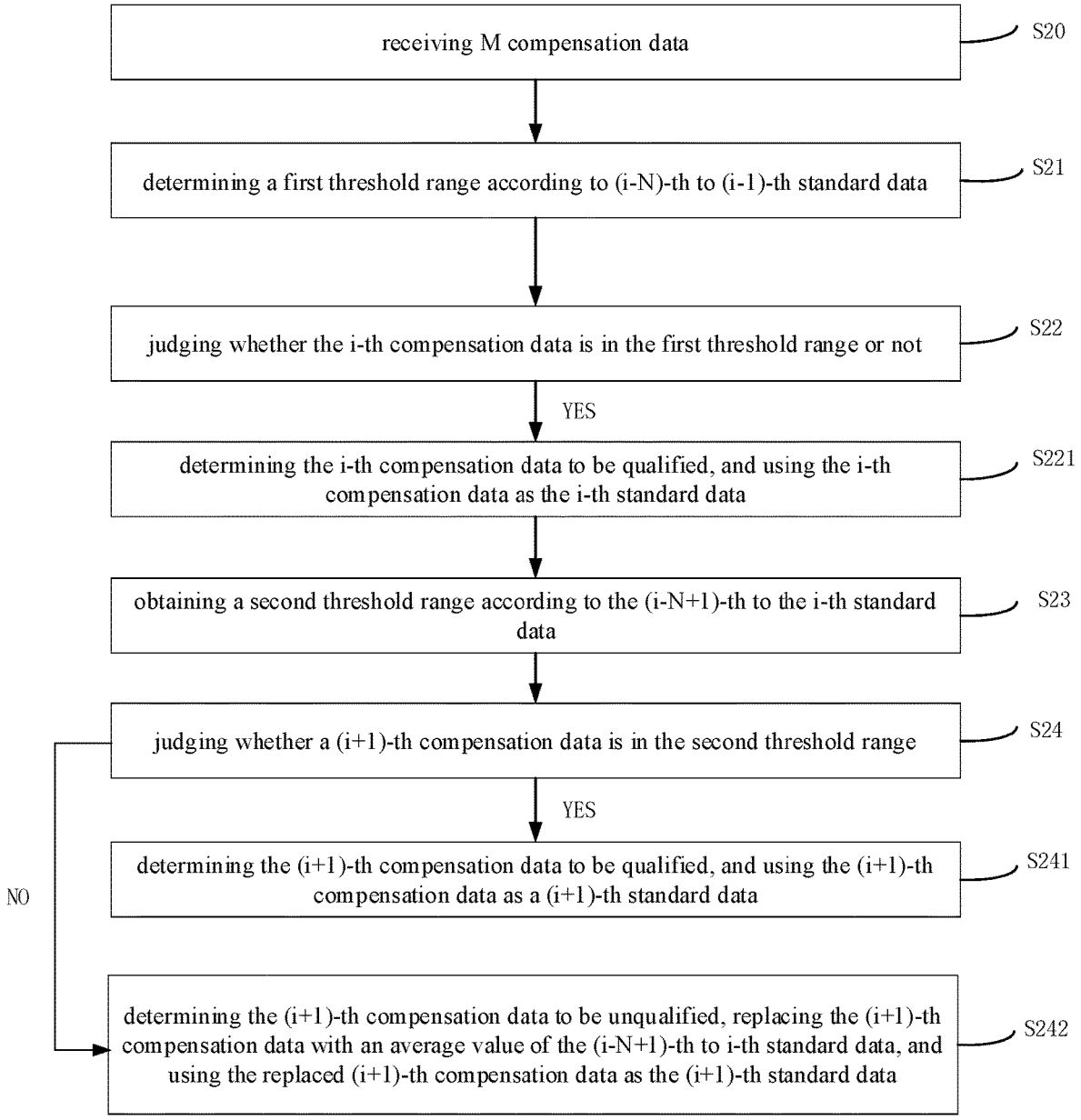
FIG. 4 is schematic flow chart of another method for processing compensation data to be applied to a pixel circuit according to an embodiment of the present disclosure.
Figure 5:
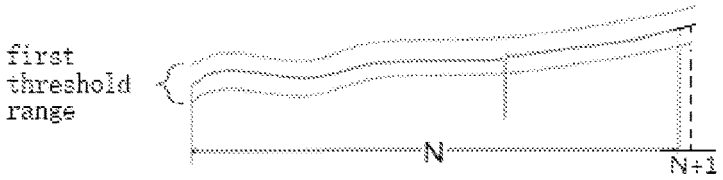
FIG. 5 is a schematic graph of a method for processing compensation data to be applied to a pixel circuit according to an embodiment of the present disclosure.

As shown in FIG. 4, an embodiment of the present disclosure provides a method for processing compensation data to be applied to a pixel circuit, including the following steps.

Step S20 includes receiving M compensation data, the M compensation data are respectively used for M adjacent pixel circuits, and any two adjacent compensation data are respectively used for two adjacent pixel circuits, where M is an integer greater than or equal to 4.

Step S21 includes determining a first threshold range according to (i−N)-th to (i−1)-th standard data, a midpoint of the first threshold range and a length of the first threshold range both depend on the (i−N)-th to (i−1)-th standard data, i is an integer greater than N and less than or equal to M, and N is an integer greater than or equal to 2.

The "standard data" refers to compensation data determined to be qualified. The first threshold range is related to a variation in the value of the standard data. It is understood that the compensation data (i.e., standard data) determined to be qualified is data which does not jump relative to its neighboring compensation data.

In the data processing method according to the embodiment of the present disclosure, the values of a plurality of compensation data to be processed are constantly changing. In judging the i-th compensation data, it is determined whether the i-th compensation data is qualified by using the first threshold range obtained based on N qualified compensation data (including the replaced compensation data) before the i-th compensation data. The midpoint and length of the first threshold range both depend on the (i−N)-th to (i−1)-th standard data. The data processing method according to the embodiment of the present disclosure can judge whether the compensation data is qualified or not more accurately, so that the accuracy of the data is ensured.

In an embodiment of the present disclosure, obtaining the first threshold range according to the (i−N)-th to (i−1)-th standard data includes: obtaining the midpoint and length of the first threshold range according to the average value of the (i−N)-th to (i−1)-th standard data.

In an embodiment of the present disclosure, the first threshold range is (A1, A2), where A1 equals to the average value of the (i−N)-th to (i−1)-th standard data minus a product of a correction coefficient and the average value of the (i−N)-th to (i−1)-th standard data, and A2 equals to the average value of the (i−N)-th to (i−1)-th standard data plus the product of the correction coefficient and the average value of the (i−N)-th to (i−1)-th standard data.

That is, the average value of the (i−N)-th to (i−1)-th standard data determines the position of the first threshold range in the coordinate system, and the correction coefficient and the average value of the (i−N)-th to (i−1)-th standard data determine the size of the first threshold range. In an embodiment of the present disclosure, the correction coefficient is in a range of 5% to 20%. In some embodiments, the correction coefficient is 10%. The correction coefficient can be set correspondingly according to experimental results or actual needs.

Step S22 includes judging whether the i-th compensation data is in the first threshold range.

Each compensation data is judged by a threshold range obtained from the preceding N standard data.

Step S221 includes determining the i-th compensation data to be qualified, and using the i-th compensation data as the i-th standard data, if the i-th compensation data is in the first threshold range.

That is, the i-th qualified compensation data may be used as the i-th standard data subsequently.

Step S23 includes obtaining a second threshold range according to the (i−N+1)-th to the i-th standard data, and a midpoint and a length of the second threshold range depend on the (i−N+1)-th to the i-th standard data.

The second threshold range is equivalent to a threshold range obtained from another N consecutive standard data.

In an embodiment of the present disclosure, obtaining the second threshold range according to the (i−N+1)-th to i-th standard data includes: obtaining the midpoint and the length of the second threshold range according to the average value of the (i−N+1)-th to i-th standard data.

In an embodiment of the present disclosure, the second threshold range is (B1, B2), where B1 equals to the average value of the (i−N+1)-th to i-th standard data minus a product of a correction coefficient and the average value of the (i−N+1)-th to i-th standard data, and B2 equals to the average value of (i−N+1)-th to i-th standard data plus the product of the correction coefficient and the average value of the (i−N+1)-th to i-th standard data.

That is, the average value of the (i−N+1)-th to i-th standard data determines the position of the second threshold range in the coordinate system, and the correction coefficient and the average value of the (i−N+1)-th to i-th standard data determine the size of the second threshold range. In some embodiments, the correction coefficient is 10%. The correction coefficient can be set correspondingly according to experimental results or actual needs.

Step S24 includes judging whether a (i+1)-th compensation data is in the second threshold range.

Step S241 includes determining the (i+1)-th compensation data to be qualified, and using the (i+1)-th compensation data as the (i+1)-th standard data, if the (i+1)-th compensation data is in the second threshold range.

Step S242 includes determining the (i+1)-th compensation data to be unqualified, replacing the (i+1)-th compensation data with an average value of the (i−N+1)-th to i-th standard data, and using the replaced (i+1)-th compensation data as the (i+1)-th standard data, if the (i+1)-th compensation data is not in the second threshold range.

It should be noted that the steps of determining the threshold range and judging whether the compensation data is in the threshold range may be repeatedly performed after step S241. In the data processing method according to the embodiment of the present disclosure, in each processing, consecutive N standard data are selected to form a threshold range for judging the (N+1)-th compensation data; and in the next processing, the first standard data in the N standard data is removed and the (N+1)-th standard data is added to form another threshold range for judging the (N+2)-th compensation data, and so on, thus finally judging all the compensation data.

It is to be noted that, in the data processing method according to the present disclosure, initially, the first to N-th compensation data are directly regarded as the first to N-th valid data for judgment of the subsequent compensation data. In some embodiments, after the judgment of M compensation data is completed in a first order, the M compensation data may be judged again in a second order opposite to the first order, so that a more accurate judgment result can be obtained. For example, the M compensation data may be first processed in the order of the first compensation data, the second compensation data, . . . , and the M-th compensation data, and then processed in the order of the M-th compensation data, the (M-1)-th compensation data, . . . , and the first compensation data.

An embodiment of the present disclosure provides a device for processing M compensation data to be applied to a pixel circuit, including:

a computing device configured to obtain a first threshold range according to (i−N)-th to (i−1)-th standard data, a midpoint and a length of the first threshold range both depending on the (i−N)-th to (i−1)-th standard data, i being an integer greater than N and less than or equal to M, N being an integer greater than or equal to 2, and M being an integer greater than or equal to 3; and a judging device configured to judge whether an i-th compensation data is in the first threshold range.

In an embodiment of the present disclosure, the above-described data processing method according to the present disclosure may be implemented in a display process of a display panel. In some embodiments, during the display process of each frame, when any row of pixels is scanned, the compensation data corresponding to the row of pixels is processed using the method according to the present disclosure.

Figure 6:
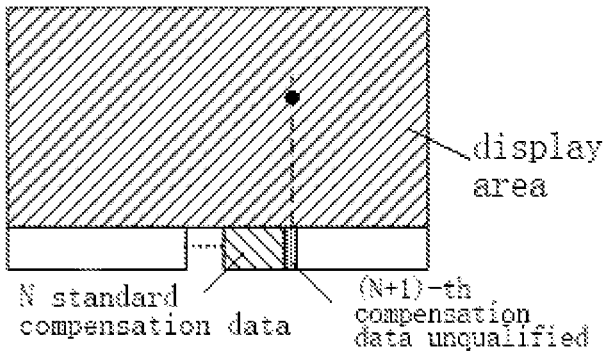
FIG. 6 is a schematic diagram of a method for processing compensation data to be applied to a pixel circuit according to an embodiment of the present disclosure.

It should be noted that, the display panel has a plurality of pixels distributed in an array, each pixel corresponds to one compensation data, and the method according to the present disclosure is used for processing the compensation data of each pixel, so that the compensation data can accurately compensate the display data of the corresponding pixel, thereby achieving normal display of the display panel and avoiding the occurrence of defects such as a white picture due to inaccurate compensation data, as shown in FIG. 6.

In the display process of each frame of the display panel, pixels are scanned line by line to display the frame. That is, during the display process of each frame, at the time of scanning each row of pixels, the compensation data corresponding to the row of pixels is processed using the method according to the present disclosure, i.e., the compensation data of the scanned row is filtered in each frame. In addition, the correction coefficient in the present disclosure relates to the characteristics of the back plate of the corresponding display panel.

In the embodiment according to the present disclosure, during the display process of each frame, when any row of pixels is scanned, the compensation data corresponding to the row of pixels is processed by using the method according to the present disclosure.

In some embodiments of the present disclosure, during the display process of each frame, only the compensation data corresponding to one row of pixels is processed using the method according to the present disclosure. That is, M frames are required to complete processing of the compensation data of M rows of pixels.

The present disclosure also provides a processing device for processing compensation data to be applied to a pixel circuit of a display panel. The processing device is configured to:

receive M compensation data, wherein the M compensation data are respectively used for M adjacent pixel circuits of the display panel, any two adjacent compensation data are respectively used for two adjacent pixel circuits, and M is an integer greater than or equal to 3;

determine a first threshold range according to (i−N)-th to (i−1)-th standard data, wherein a midpoint of the first threshold range and a length of the first threshold range both depend on the (i−N)-th to (i−1)-th standard data, where i is an integer greater than N and less than or equal to M, and N is an integer greater than or equal to 2; and judge whether an i-th compensation data is in the first threshold range or not;

in response to the i-th compensation data being in the first threshold range, determine the i-th compensation data to be qualified, and use the i-th compensation data as an i-th standard data; and in response to the i-th compensation data not being in the first threshold range, determine the i-th compensation data to be unqualified, replace the i-th compensation data with an average value of the (i−N)-th to (i−1)-th standard data, and use the replaced i-th compensation data as the i-th standard data.

In some embodiments of the present disclosure, the processing device is configured to obtain the midpoint of the first threshold range and the length of the first threshold range according to the average value of the (i−N)-th to (i−1)-th standard data.

In some embodiments of the present disclosure, the first threshold range is (A1, A2), where A1 equals to the average value of the (i−N)-th to (i−1)-th standard data minus a product of a correction coefficient and the average value of the (i−N)-th to (i−1)-th standard data, A2 equals to the average value of the (i−N)-th to (i−1)-th standard data plus the product of the correction coefficient and the average value of the (i−N)-th to (i−1)-th standard data, and the correction coefficient is greater than zero and less than 1.

In an embodiment of the present disclosure, the processing device may be implemented as a processor.

As shown in FIG. 6, the present disclosure provides a display panel including: the processing device according to the present disclosure.

The display panel according to the embodiment can utilize the processing device according to the present disclosure to process the compensation data of each pixel, and thus can ensure the accuracy of judgment on the compensation data, thereby improving the accuracy of the compensation data and ensuring the normal display of the display panel.

The display panel may be any product or component with a display function, such as a liquid crystal display panel, an organic light emitting diode (OLED) display panel, an electronic paper, a mobile phone, a tablet computer, a television, a display, a notebook computer, a digital photo frame, a navigator or the like.

It should be noted that, in the present disclosure, relational terms such as first, second, and the like are used solely to distinguish one entity or operation from another entity or operation without necessarily requiring or implying any actual such relationship or order between such entities or operations. Also, the terms "comprise", "include" or any other variation thereof, are intended to cover a non-exclusive inclusion, such that a process, method, article, or apparatus that includes a list of elements not only includes those elements but may also include other elements not expressly listed or inherent to such process, method, article, or apparatus. Without further limitation, an element defined by the phrase "comprising an" does not exclude the presence of other identical elements in the process, method, article, or apparatus that comprises the element.

The embodiments of the present disclosure are described as above, and these embodiments are not intended to be exhaustive or to limit the invention to the precise embodiments disclosed. Obviously, many modifications and variations are possible in light of the above description. The embodiments were chosen and described in order to better explain the principles and the practical application of the present disclosure, to thereby enable a person of skill in the art to better utilize the present disclosure and various embodiments with various modifications as are suited to the particular use contemplated. The present disclosure is to be limited only by the claims and their full scope and equivalents.

What is claimed is:

1. A method for processing compensation data to be applied to a pixel circuit, comprising:

receiving M compensation data, wherein the M compensation data are respectively used for M adjacent pixel circuits, any two adjacent compensation data are respectively used for two adjacent pixel circuits, and M is an integer greater than or equal to 3;

determining a first threshold range according to (i−N)-th to (i−1)-th standard data, wherein a midpoint of the first threshold range and a length of the first threshold range both depend on the (i−N)-th to (i−1)-th standard data, i is an integer greater than N and less than or equal to M, and N is an integer greater than or equal to 2;

judging whether an i-th compensation data is in the first threshold range or not;

in response to the i-th compensation data being in the first threshold range, determining the i-th compensation data to be qualified and using the i-th compensation data as an i-th standard data; and in response to the i-th compensation data not being in the first threshold range, determining the i-th compensation data to be unqualified, replacing the i-th compensation data with an average value of the (i−N)-th to (i−1)-th standard data, and using the replaced i-th compensation data as the i-th standard data, wherein after in response to the i-th compensation data being in the first threshold range, determining the i-th compensation data to be qualified and using the i-th compensation data as an i-th standard data, the method comprises:

obtaining a second threshold range according to (i−N+1)-th to i-th standard data, wherein a midpoint of the second threshold range and a length of the second threshold range both depend on the (i−N+1)-th to i-th standard data;

judging whether a (i+1)-th compensation data is in the second threshold range;

in response to the (i+1)-th compensation data being in the second threshold range, determining the (i+1)-th compensation data to be qualified, and using the (i+1)-th compensation data as a (i+1)-th standard data; and in response to the (i+1)-th compensation data not being in the second threshold range, determining the (i+1)-th compensation data to be unqualified, replacing the (i+1)-th compensation data with an average value of the (i−N+1)-th to i-th standard data, and using the replaced (i+1)-th compensation data as the (i+1)-th standard data.

2. The method of claim 1, wherein determining a first threshold range based on (i−N)-th to (i−1)-th standard data comprises:

obtaining the midpoint of the first threshold range and the length of the first threshold range according to the average value of the (i−N)-th to (i−1)-th standard data.

3. The method of claim 2, wherein the first threshold range is (A1, A2), where A1 equals to the average value of the (i−N)-th to (i−1)-th standard data minus a product of a correction coefficient and the average value of the (i−N)-th to (i−1)-th standard data, A2 equals to the average value of the (i−N)-th to (i−1)-th standard data plus the product of the correction coefficient and the average value of the (i−N)-th to (i−1)-th standard data, and the correction coefficient is greater than zero and less than 1.

4. The method of claim 3, wherein the correction coefficient is in a range of 5% to 20%.

5. The method of claim 4, wherein the correction coefficient is 10%.

6. The method of claim 1, wherein obtaining a second threshold range according to (i−N+1)-th to i-th standard data comprises:

obtaining the midpoint of the second threshold range and the length of the second threshold range according to the average value of the (i−N+1)-th to i-th standard data.

7. The method of claim 6, wherein the second threshold range is (B1, B2), where B1 equals to the average value of the (i−N+1)-th to i-th standard data minus a product of a correction coefficient and the average value of the (i−N+1)-th to i-th standard data, and B2 equals to the average value of (i−N+1)-th to i-th standard data plus the product of the correction coefficient and the average value of the (i−N+1)-th to i-th standard data.

8. The method of claim 1, wherein in a display process of each frame, when any row of pixels is scanned, the compensation data corresponding to the row of pixels is processed by using the method.

9. A processing device for processing compensation data to be applied to a pixel circuit, the processing device being configured to:

receive M compensation data, wherein the M compensation data are respectively used for M adjacent pixel circuits of a display panel, any two adjacent compensation data are respectively used for two adjacent pixel circuits, and M is an integer greater than or equal to 3;

determine a first threshold range according to (i−N)-th to (i−1)-th standard data, wherein a midpoint of the first threshold range and a length of the first threshold range both depend on the (i−N)-th to (i−1)-th standard data, i is an integer greater than N and less than or equal to M, and N is an integer greater than or equal to 2;

judge whether an i-th compensation data is in the first threshold range or not;

in response to the i-th compensation data being in the first threshold range, determine the i-th compensation data to be qualified, and use the i-th compensation data as an i-th standard data; and in response to the i-th compensation data not being in the first threshold range, determine the i-th compensation data to be unqualified, replace the i-th compensation data with an average value of the (i−N)-th to (i−1)-th standard data, and use the replaced i-th compensation data as the i-th standard data, wherein after in response to the i-th compensation data being in the first threshold range, determining the i-th compensation data to be qualified and using the i-th compensation data as an i-th standard data, the processing device is configured to:

obtain a second threshold range according to (i−N+1)-th to i-th standard data, wherein a midpoint of the second threshold range and a length of the second threshold range both depend on the (i−N+1)-th to i-th standard data;

judge whether a (i+1)-th compensation data is in the second threshold range;

in response to the (i+1)-th compensation data being in the second threshold range, determine the (i+1)-th compensation data to be qualified, and use the (i+1)-th compensation data as a (i+1)-th standard data; and in response to the (i+1)-th compensation data not being in the second threshold range, determine the (i+1)-th compensation data to be unqualified, replace the (i+1)-th compensation data with an average value of the (i−N+1)-th to i-th standard data, and use the replaced (i+1)-th compensation data as the (i+1)-th standard data.

10. The processing device of claim 9, wherein the processing device is configured to obtain the midpoint of the first threshold range and the length of the first threshold range according to the average value of the (i−N)-th to (i−1)-th standard data.

11. The processing device of claim 10, wherein the first threshold range is (A1, A2), where A1 equals to the average value of the (i−N)-th to (i−1)-th standard data minus a product of a correction coefficient and the average value of the (i−N)-th to (i−1)-th standard data, A2 equals to the average value of the (i−N)-th to (i−1)-th standard data plus the product of the correction coefficient and the average value of the (i−N)-th to (i−1)-th standard data, and the correction coefficient is greater than zero and less than 1.

12. A display panel, comprising:

the processing device of claim 9.

* * * * *